US008322805B2

(12) United States Patent
Kwon et al.

(10) Patent No.: US 8,322,805 B2
(45) Date of Patent: Dec. 4, 2012

(54) REFRIGERATOR

(75) Inventors: Hong Sik Kwon, Seoul (KR); Kyu Tae Park, Seoul (KR); Kyeong Chul Cho, Seoul (KR); Seon Il Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 26 days.

(21) Appl. No.: 12/792,575

(22) Filed: Jun. 2, 2010

(65) Prior Publication Data

US 2010/0308705 A1 Dec. 9, 2010

(30) Foreign Application Priority Data

Jun. 3, 2009 (KR) ..... 10-2009-0049241

(51) Int. Cl.

| | |
|---|---|
| ***A47B 96/04*** | (2006.01) |
| ***A47B 81/00*** | (2006.01) |
| ***A47B 97/00*** | (2006.01) |
| ***A47B 77/10*** | (2006.01) |

(52) U.S. Cl. ..... 312/405.1; 312/275; 312/315; 312/292

(58) Field of Classification Search ..... 312/271, 312/273, 274, 275, 405, 405.1, 311, 313, 312/315, 292; 16/362, 363
See application file for complete search history.

(56) References Cited

U.S. PATENT DOCUMENTS

| | | | | | |
|---|---|---|---|---|---|
| 1,275,511 | A | * | 8/1918 | Welch | 312/292 |
| 1,925,083 | A | * | 4/1932 | Hoidn | 211/73 |
| 2,033,860 | A | * | 3/1936 | Otte | 312/408 |
| 2,046,909 | A | * | 7/1936 | Terry et al. | 312/300 |
| 2,062,360 | A | * | 12/1936 | Goulooze | 312/275 |
| 2,095,811 | A | * | 10/1937 | Goulooze | 312/274 |
| 2,103,885 | A | * | 12/1937 | Whalen | 312/404 |
| 2,112,771 | A | * | 3/1938 | Goulooze | 312/275 |
| 2,122,501 | A | * | 7/1938 | Thomas | 312/242 |
| 2,129,923 | A | * | 9/1938 | Frankel | 312/236 |
| 2,131,680 | A | * | 9/1938 | Zahodiakin | 62/266 |
| 2,150,064 | A | * | 3/1939 | Robert et al. | 62/266 |
| 2,281,430 | A | * | 4/1942 | Grant | 312/292 |
| 2,319,470 | A | * | 5/1943 | Nobles | 211/153 |
| 2,415,122 | A | * | 2/1947 | Woodward | 292/230 |
| 2,656,688 | A | * | 10/1953 | Hinkel | 62/441 |

(Continued)

FOREIGN PATENT DOCUMENTS

EP 0539558 * 5/1993

(Continued)

OTHER PUBLICATIONS

PCT International Search Report dated Dec. 20, 2010, for Application No. PCT/KR2010/003543, 3 pages.

*Primary Examiner* — Darnell Jayne
*Assistant Examiner* — Kimberley S Wright
(74) *Attorney, Agent, or Firm* — Fish & Richardson P.C.

(57) ABSTRACT

Disclosed is a refrigerator. The refrigerator includes a cabinet configured to define an exterior boundary of the refrigerator with at least one opening therein. The refrigerator also includes a storage chamber defined by interior walls of the cabinet and configured to store food stuffs. The refrigerator further includes a door configured to open and close an access point to the storage chamber by rotating about a rotational axis. In addition, the refrigerator includes a supporting member positioned at the storage chamber and configured to be moved in connection with opening and closing of the door.

22 Claims, 11 Drawing Sheets

U.S. PATENT DOCUMENTS

| | | | | | |
|---|---|---|---|---|---|
| 2,685,372 | A | * | 8/1954 | Palaith | 211/153 |
| 2,692,813 | A | * | 10/1954 | Toronto | 312/408 |
| 2,717,816 | A | * | 9/1955 | Turner | 108/45 |
| 2,767,042 | A | * | 10/1956 | Kesling | 312/313 |
| 3,125,390 | A | * | 3/1964 | Woolley | 312/329 |
| 3,151,576 | A | * | 10/1964 | Patterson | 108/2 |
| 3,157,306 | A | * | 11/1964 | Courson | 312/405 |
| 3,212,835 | A | * | 10/1965 | Beckett et al. | 312/311 |
| 3,218,111 | A | * | 11/1965 | Steiner | 312/405.1 |
| 3,389,424 | A | * | 6/1968 | Fellwock | 16/392 |
| 3,510,986 | A | * | 5/1970 | Berkowitz | 49/386 |
| 3,625,371 | A | * | 12/1971 | Dill | 211/153 |
| 3,877,767 | A | * | 4/1975 | Bright | 312/408 |
| 4,084,703 | A | * | 4/1978 | Hossalla et al. | 211/153 |
| 4,087,140 | A | * | 5/1978 | Linstromberg | 312/292 |
| 4,368,622 | A | * | 1/1983 | Brooks | 62/157 |
| 4,486,981 | A | * | 12/1984 | Billen | 49/501 |
| 4,514,021 | A | * | 4/1985 | Sundermeier et al. | 312/291 |
| 4,586,347 | A | * | 5/1986 | McCarty | 62/265 |
| 4,639,051 | A | * | 1/1987 | DeBruyn | 312/275 |
| 4,914,340 | A | * | 4/1990 | Fox | 312/211 |
| 5,209,082 | A | * | 5/1993 | Ha | 62/265 |
| 5,340,209 | A | * | 8/1994 | Kolbe et al. | 312/408 |
| 5,588,731 | A | * | 12/1996 | Schmidt et al. | 312/405 |
| 5,966,963 | A | * | 10/1999 | Kovalaske | 62/441 |
| 6,055,823 | A | * | 5/2000 | Baker et al. | 62/265 |
| 6,056,378 | A | * | 5/2000 | Semon et al. | 312/246 |
| 6,148,813 | A | * | 11/2000 | Barnes et al. | 126/339 |
| 6,260,362 | B1 | * | 7/2001 | Choi | 62/89 |
| 6,401,478 | B2 | * | 6/2002 | Dasher et al. | 62/344 |
| 6,547,349 | B2 | * | 4/2003 | Sessa et al. | 312/352 |
| D527,398 | S | * | 8/2006 | Kim et al. | D15/86 |
| 7,357,469 | B2 | * | 4/2008 | Ertz | 312/408 |
| 7,410,230 | B2 | * | 8/2008 | Anderson et al. | 312/407 |
| 7,784,219 | B2 | * | 8/2010 | Yoshikawa et al. | 49/379 |
| D629,022 | S | * | 12/2010 | Cho et al. | D15/85 |
| 2002/0093276 | A1 | * | 7/2002 | Kawakami | 312/405 |
| 2003/0102787 | A1 | * | 6/2003 | Whitaker et al. | 312/405.1 |
| 2005/0258724 | A1 | | 11/2005 | Hwa | |
| 2006/0232176 | A1 | * | 10/2006 | Kim et al. | 312/405 |
| 2007/0182296 | A1 | * | 8/2007 | Lee | 312/405.1 |
| 2007/0284985 | A1 | * | 12/2007 | Wing | 312/408 |
| 2009/0139260 | A1 | * | 6/2009 | Yoshikawa et al. | 62/449 |
| 2010/0170279 | A1 | * | 7/2010 | Aoki | 62/264 |
| 2010/0307186 | A1 | * | 12/2010 | Kwon et al. | 62/407 |
| 2010/0307188 | A1 | * | 12/2010 | Kwon et al. | 62/441 |
| 2011/0023528 | A1 | * | 2/2011 | Kwon et al. | 62/441 |
| 2011/0146323 | A1 | * | 6/2011 | Choi | 62/340 |
| 2011/0232317 | A1 | * | 9/2011 | Flores | 62/320 |
| 2011/0232323 | A1 | * | 9/2011 | Morris | 62/457.9 |

FOREIGN PATENT DOCUMENTS

| | | | | |
|---|---|---|---|---|
| JP | 408233439 | | * | 9/1996 |
| JP | 10-009757 | A | | 1/1998 |
| JP | KR2003279240 | | * | 10/2003 |
| KR | 1999-0042339 | A | | 6/1999 |
| KR | 1999-0039593 | A | | 11/1999 |
| KR | 20-0164322 | Y1 | | 2/2000 |
| KR | 10-0376167 | B1 | | 3/2003 |
| KR | 2003-0083813 | A | | 11/2003 |
| KR | 10-20050111094 | A1 | | 11/2005 |
| KR | 10-0733309 | B1 | | 6/2007 |
| KR | 10-0887575 | B1 | | 3/2009 |
| KR | 20090077564 | | * | 7/2009 |

* cited by examiner

REFRIGERATOR

CROSS REFERENCE TO RELATED APPLICATION

This application claims the benefit of the priority to Korean Application No. 10-2009-0049241, filed on Jun. 3, 2009, which is hereby expressly incorporated by reference in its entirely.

FIELD

The present disclosure relates to a refrigerator.

BACKGROUND

Refrigerators have storage chambers to store food, and these storage chambers are selectively opened and closed by doors. In general, the storage chambers include a freezing chamber and a refrigerating chamber, and the refrigerators are classified into various types according to disposition shapes of the freezing chamber and the refrigerating chamber. Further, the refrigerators are classified according to shapes of the doors and opening and closing structures thereof.

Designated spaces to store food are generally provided on the doors. For example, a designated space (e.g., a door basket) is provided on the inner surface of a door, and food having a relatively tall height, such as a bottle, is stored in the basket. When the door is opened, food is put into and taken out of the door basket. That is, the door basket is accessible from the inside of the door. Another shape of the food storage spaces provided in the door is a storage chamber called as a home bar. Such a storage chamber is defined in the door, but the storage chamber is accessible from the outside of the door, in principle, through a subsidiary door provided in the door. That is, food may be put into and taken out of the door storage chamber by opening the subsidiary door without opening the door. As described above, as structures of the refrigerators are continually diversified, demand for an increase in convenience of the refrigerators in use is required so as to meet the diversification.

SUMMARY

In one aspect, a refrigerator includes a cabinet configured to define an exterior boundary of the refrigerator with at least one opening therein. The refrigerator also includes a storage chamber defined by interior walls of the cabinet and configured to store food stuffs. The refrigerator further includes a door configured to open and close an access point to the storage chamber by rotating about a rotational axis. In addition, the refrigerator includes a supporting member positioned at the storage chamber and configured to be moved in connection with opening and closing of the door.

Implementations may includes one or more of the following features. For example, the refrigerator further includes a motion conversion unit coupled to the door and the supporting member, respectively, and configured to convert rotation of the door into movement of the supporting member. The supporting member is configured to be rotated about a rotational axis in connection with opening and closing of the door. The supporting member is configured to be moved forward based on opening of the door and to be moved backward based on closing of the door. The motion conversion unit comprises a link member and a door connection part.

In some examples, the refrigerator further includes a stopper configured to be extended from the door connection part and stop movement of the door connection part when the door is opened. The refrigerator further includes a connection hole configured to connect the door and the motion conversion unit. The refrigerator further includes a rotary shaft configured to be rotatably connected to the connection hole, wherein the connection hole has a greater inner diameter than an outer diameter of the rotary shaft.

The connection hole is extended in a lengthwise direction of the link member. The supporting member has a tray to enlarge a size of the supporting area. When the door is opened, the supporting member is opened in response to the opening of the door, and when the door is closed, the supporting member is closed in response to the closing of the door.

In another aspect, a refrigerator includes a cabinet configured to define an exterior boundary of the refrigerator with at least one opening therein. The refrigerator also includes a storage chamber defined by interior walls of the cabinet and configured to store food stuffs. The refrigerator further includes a door configured to open and close the storage chamber by rotating about a rotational axis. In addition, the refrigerator includes a supporting member positioned at the storage chamber and configured to be opened and closed in connection with opening and closing of the door.

Implementations may include one or more of the following features. For example, the refrigerator further includes a motion conversion unit coupled to the door and the supporting member, respectively, and configured to convert rotation of the door into movement of the supporting member. The supporting member is configured to be rotated about a rotational axis based on opening and closing of the door. The supporting member is configured to be moved forward and backward in connection with opening and closing of the door. The motion conversion unit comprises a link member and a door connection part.

In some examples, the refrigerator further includes a connection hole configured to connect the door and the motion conversion unit. The connection hole is extended in a lengthwise direction of the link member. The supporting member has a tray to enlarge a size of the supporting area. When the door is opened, the supporting member is opened in response to the opening of the door, and when the door is closed, the support is closed in response to the closing of the door.

In yet another aspect, a refrigerator includes a cabinet configured to define an exterior boundary of the refrigerator with at least one opening therein. The refrigerator also includes a first storage chamber defined by interior walls of the cabinet and configured to store food stuffs. The refrigerator further includes a first door configured to open and close the first storage chamber and a second storage chamber that is smaller than the first storage chamber defined at a side of the first door, and that is configured to enable access to food stuffs while the first door remains closed. In addition, the refrigerator includes a second door, located in a predetermined portion of the first door, configured to open and close the second storage chamber by rotating about a rotational axis and a supporting member positioned at the second storage chamber and configured to be moved in connection with opening and closing of the second door.

Implementations may include one or more of the following features. For example, the refrigerator further includes a motion conversion unit coupled to the second door and the supporting member, respectively, and configured to convert rotation of the second door into movement of the supporting member. The support member is configured to be rotated about a rotational axis in response to opening and closing of the second door. The supporting member is configured to be moved forward and backward in response to opening and closing of the second door. The motion conversion unit comprises a link member and a door connection part.

In some examples, the refrigerator further includes a connection hole is configured to connect the second door and the motion conversion unit, wherein the connection hole is extended in a lengthwise direction of the link member. The supporting member has a tray to enlarge size of the supporting area. When the second door is opened, the supporting member is opened in connection with the opening of the second door, and when the second door is closed, the support is closed in connection with the closing of the second door.

BRIEF DESCRIPTION OF THE DRAWINGS

FIG. 1 illustrates an opened state of first storage chambers; and

FIG. 2 illustrates an opened state of second storage chambers;

DETAILED DESCRIPTION

Hereinafter, preferred implementations of the present technology will be described in detail with reference to the accompanying drawings.

Figure 1:
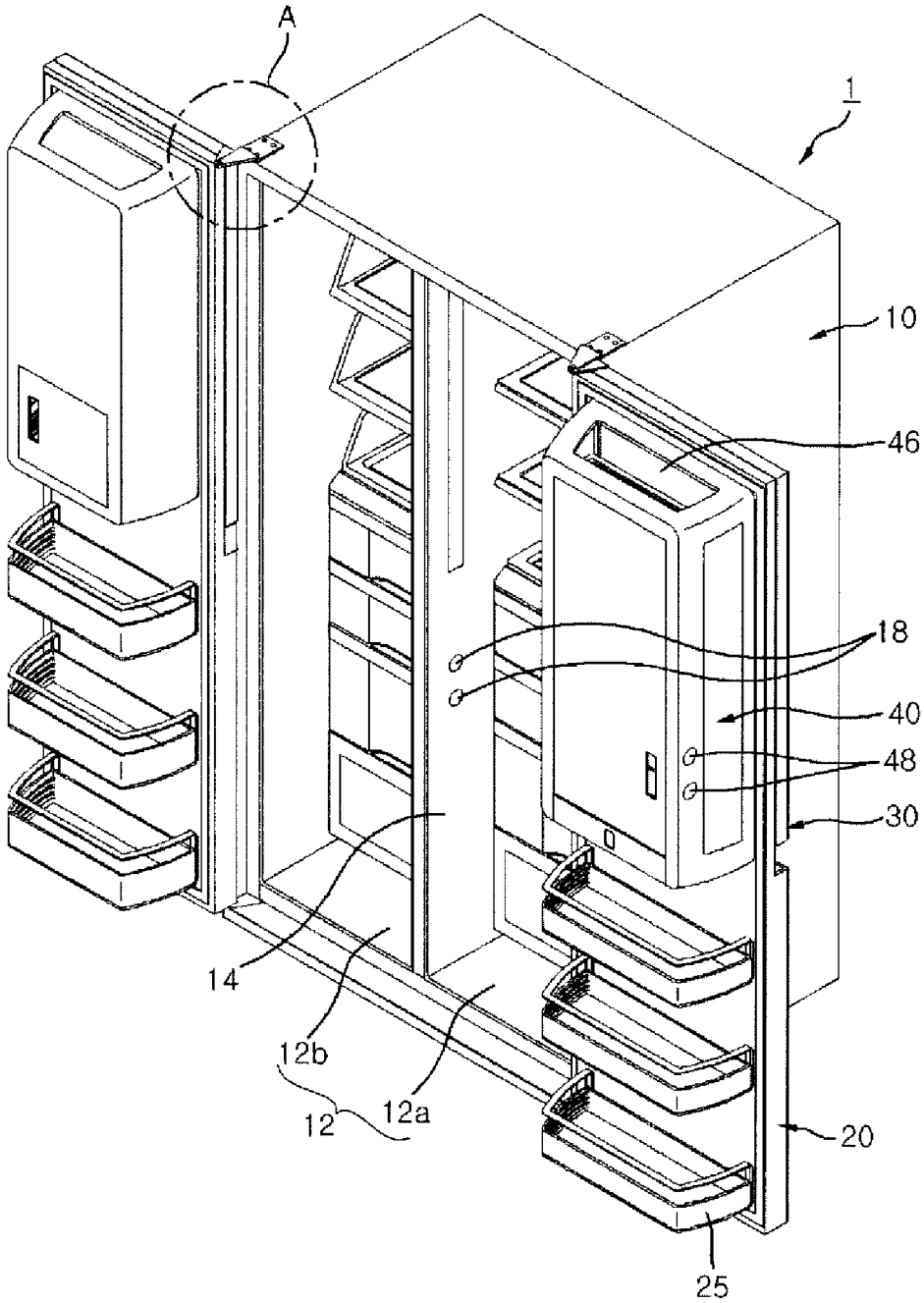
FIGS. 1 and 2 are views of a refrigerator, for example.

First, with reference to FIG. 1, an overall structure of a refrigerator in accordance with one implementation of the present technology will be described. Hereinafter, a side by side type refrigerator will be exemplarily described for convenience, but the present disclosure is not limited thereto.

Storage chambers 12 (hereinafter, referred to as "first storage chambers") to store food are provided in a cabinet 10 of a refrigerator 1. The first storage chambers 12 may include a freezing chamber 12*b* and a refrigerating chamber 12*a*. In the side by side type refrigerator, the freezing chamber 12*b* and the refrigerating chamber 12*a* are may be arranged horizontally, that is, side by side.

Doors 20 (hereinafter, referred to as "first doors") to selectively open and close the first storage chambers 12 are provided on the refrigerator cabinet 10. Storage chambers 40 (hereinafter, referred to as "second storage chambers") to store food are also provided in the first doors 20, and the second storage chambers 40 are selectively opened and closed by doors 30 (hereinafter, referred to as "second doors").

Now, respective parts of the refrigerator 1 will be described in detail.

The first storage chambers 12 provided in the cabinet 10 of the refrigerator 1 include the freezing chamber 12*b* and the refrigerating chamber 12*a*, which are divided by a partition wall 14, and racks and drawers are installed in the first storage chambers 12.

The second storage chambers 40 are provided in the first doors 20, and have designated spaces to store food. The second storage chambers 40 are generally configured such that the designated spaces are surrounded by the second storage chambers 40. That is, the second storage chambers 40 have the designated spaces within the first doors 20, and are fundamentally accessible from the outsides of the first doors 20. That is, the second storage chambers 40 do not exclude accessibility from the inside of the doors 20, but the second storage chambers 40 are fundamentally accessible using the second doors 30 provided on the outer surfaces of the first doors 20 (with reference to FIG. 2). Further, door baskets 25, which are storage spaces defined separately from the second storage chambers 40, may be provided on the inner surfaces of the first doors 20. The door baskets 25 are configured such that designated spaces are not surrounded thereby, and thus are accessible from the insides of the first doors 20. That is, the door baskets 25 are not accessible using the second doors 30, but are accessible only by opening the first doors 20.

Since the second storage chambers 40 have the designated spaces surrounded thereby, the second storage chambers 40 may employ a structure which communicates cool air with the first storage chambers 42. For example, the second storage chamber 40 is provided with a communication part 46, which communicates with the first storage chamber 12 to allow cool air in the first storage chamber 12 to be introduced to the inside of the second storage chamber 40. Further, the second storage chamber 40 may be provided with communication parts 48, which communicate directly with front ends 18 of cool air ducts provided through the partition wall 14 of the cabinet 10 of the refrigerator 1.

Hereinafter, with reference to FIGS. 2 and 3, the first doors and the second doors will be described in detail.

Figure 2:
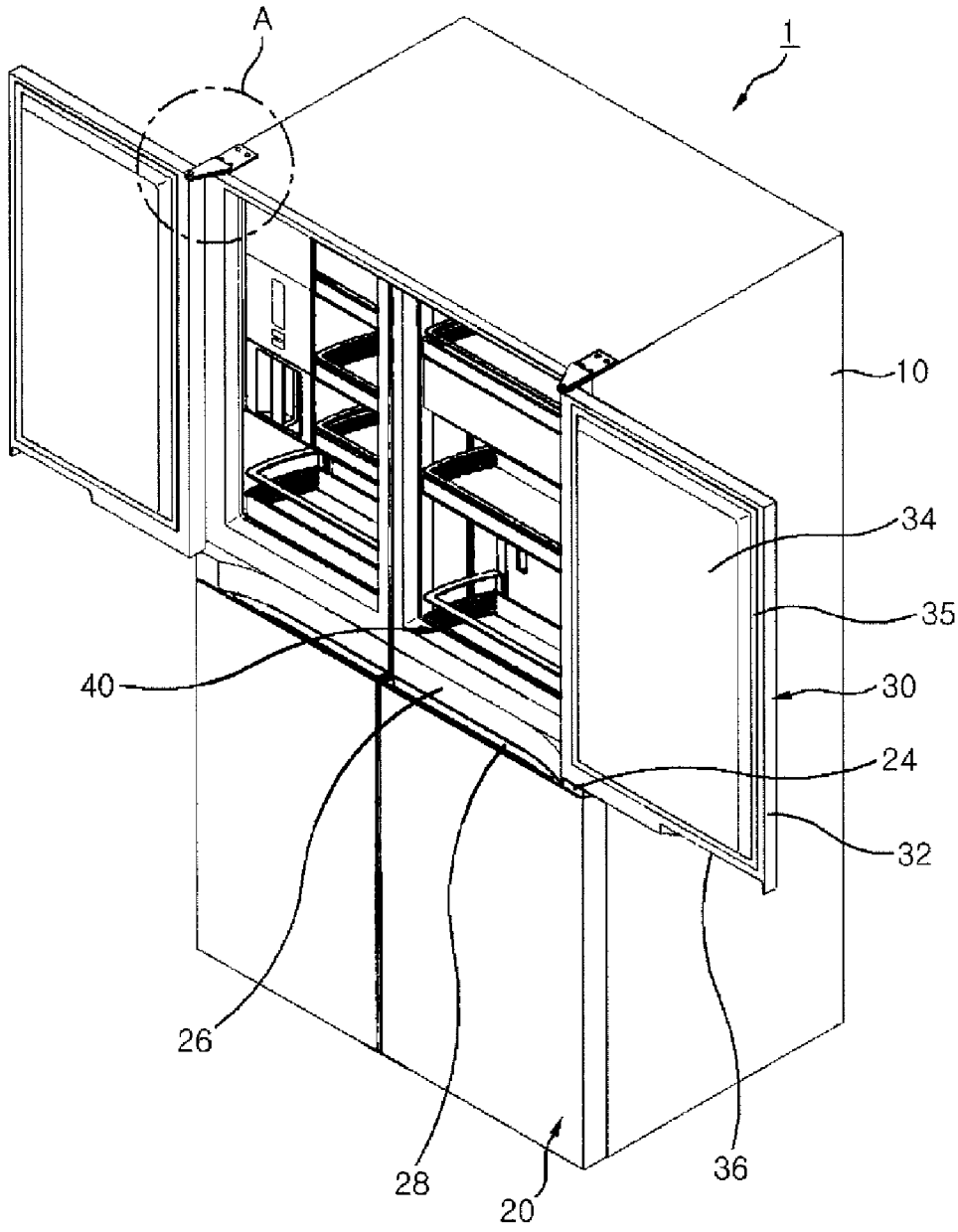
Figure 3:
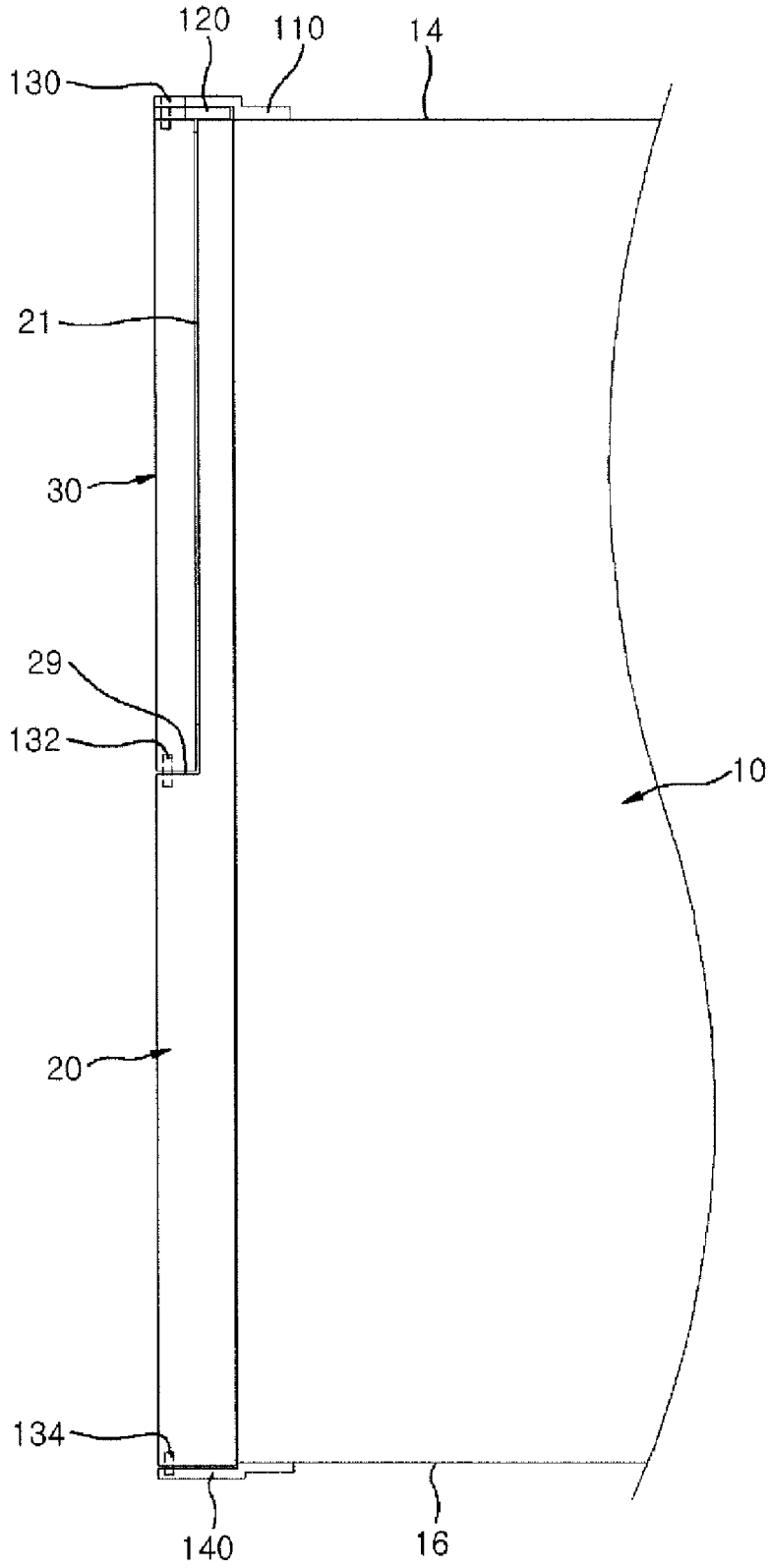
FIG. 3 is a longitudinal-sectional view of FIG. 1.

In FIG. 3, a mounting part 21 depressed in a direction of the cabinet 10 is provided at the first door 20, and the second door 30 may be installed on the mounting part 21. That is, for example, a part 29 stepped in the direction of the cabinet 10 is provided at a designated portion of the first door 20, i.e., an approximately central portion of the first door 20, as shown in FIGS. 2 and 3, and the second door 30 is located along the stepped part 29.

In some examples, the shape of the second door 30 may correspond to the shape of the first door 20. Particularly, a width of the second door 30 is substantially equal to a width of the first door 20, and a height of the second door 30 may be properly selected. Further, a thickness of the second door 30 may be equal to a thickness of the mounting part 21 provided on the first door 20. Throughout the above configuration, since the second door 30 is located at a portion of the first door 20, a user recognizes the second door 30 as the first door 20 or a portion of the first door 20, and thus the external appearance of the refrigerator 1 is not spoiled.

In this implementation, in FIG. 2, a first concave part 26 depressed inwardly to a designated depth is provided at a designated portion of the first door 20, i.e., between the lower end of the second door 30 and a connection part 24, to which the first door 20 is rotatably connected. Further, a second concave part 28 depressed downwardly from a portion of the first door 20 adjacent to the first concave part 26 is further provided on the first door 20, and a third concave part 36 depressed upward is provided at the lower end of the second door 30 adjacent to the first concave part 26. Through this configuration, the second concave part 28 and the third concave part 36 respectively serve as a handle for the first door 20 and a handle for the second door 30, and thus the first door 20 and the second door 30 do not require separate handles.

For example, a protrusion part 34, protruding to the inside of the second storage chamber, 40 is positioned on the rear surface of the second door 30, and a gasket 35 for sealing is provided around the protrusion part 34.

With reference to FIG. 3, a connecting and rotating structure among the cabinet, the first door, and the second door will be described. Here, connection of the second door 30 to the mounting part 21 of the first door 20 will be exemplarily described.

The first door 20 selectively opens and closes the first storage chamber, and the second door 30 selectively opens and closes the second storage chamber provided in the first door 20. In this implementation, a rotating direction of the first door 20 and a rotating direction of the second door 30 are identical. For example, since the first door 20 is rotated around a vertical axis, the second door 30 is also rotated around the vertical axis.

If the rotating direction of the first door 20 and the rotating direction of the second door 30 are equal, a radius of rotation of the refrigerator 1 may be determined based on the first door 20 to open and close the first storage chamber. Thus a user disposes the refrigerator 1 such that there is no obstacle around a radius of rotation of the first door 20. Also, if the rotating direction of the first door 20 and the rotating direction of the second door 30 are equal, the size of the second storage chamber provided in the first door 20 may be increased. Further, since the rotating direction of the first door 20 and the rotating direction of the second door 30 are equal, a sealing structure between the first door 20 and the second door 30 may be employed as a sealing structure between the cabinet 10 and the first door 20.

A rotary shaft of the first door 20 and a rotary shaft of the second door 30 may be parallel with each other. In this implementation, the rotary shaft of the first door 20 and the rotary shaft of the second door 30 may be arranged coaxially. Through this configuration, only one shaft may be used, and thus an assembly structure is simplified.

Now, the above coaxial arrangement will be described in detail.

As shown in FIG. 3, one side of a first connection member 110 is connected to an upper surface 14 of the cabinet 10, and the other side of the first connection member 110 is connected to an upper surface of the second door 30 by means of a rotary shaft 130 (hereinafter, referred to as an "upper rotary shaft"). One side of a second connection member 120 is connected to an upper surface of the first door 20, and the other side of the second connection member 120 is connected to the upper surface of the second door 30 by means of the same upper rotary shaft 130. The second connection member 120 is located under the first connection member 110. Therefore, the above upper rotary shaft 130 functions as the common upper rotary shaft of the first door 20 and the second door 30.

A rotary shaft 132 (hereinafter, referred to as a "lower rotary shaft for the second door") for the lower portion of the second door 30 is provided at the lower end of the second door 30. The lower rotary shaft 132 for the second door 30 is connected to the connection part 24 (with reference to FIG. 2) provided on the mounting part 21 of the first door 20. Further, a rotary shaft 134 (hereinafter, referred to as a "lower rotary shaft for the first door") for the lower portion of the first door 20 is provided on the lower end of the first door 20. The lower rotary shaft 134 for the first door 20 is connected to the lower end of the refrigerator cabinet 10 by a second connection member 140.

Hereinafter, with reference to FIGS. 4(*a*), 4(*b*), and 4(*c*), operations of the first door and the second door in accordance with this embodiment will be described.

Figure 4:
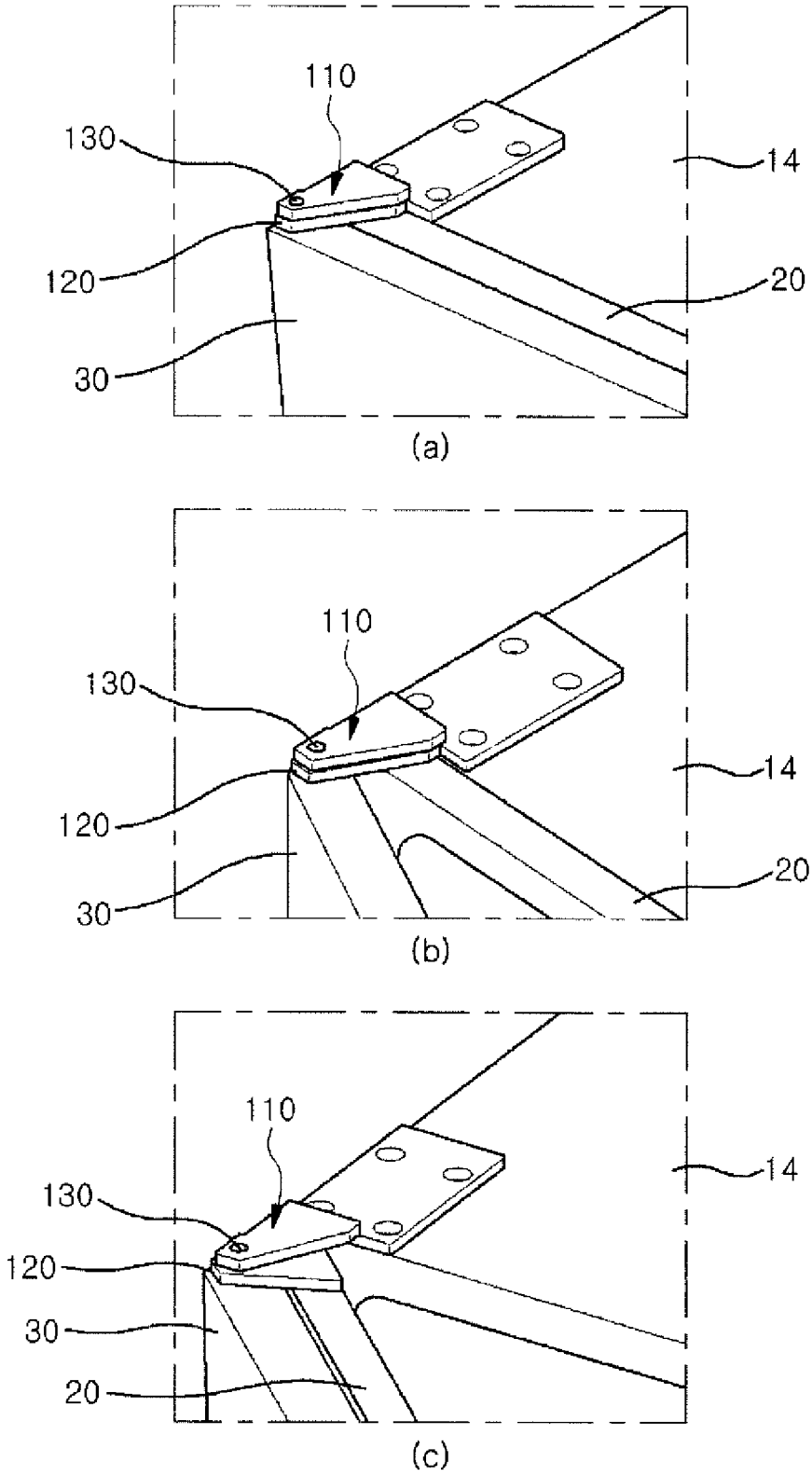
FIGS. 4(*a*), 4(*b*), and 4(*c*) are views illustrating opening of first and second doors of the refrigerator.

FIG. 4(*a*) illustrates a state in which both the first door 20 and the second door 30 are closed.

With reference to FIG. 4(*b*), opening of the second door 30 will be described. In order to access the second storage chamber 40 provided in the first door 20, the second door 30 needs to be opened. When a user pulls only the second door 30 forward, the first door 20 is not rotated and only the second door 30 is rotated around the common upper rotary shaft 130 and the lower rotary shaft 132 for the second door 30, thereby opening the second storage chamber 40.

With reference to FIG. 4(*c*), opening of the first door 20 will be described.

In order to access the first storage chamber 12, the first door 20 needs to be opened. When a user pulls the first door 20 forward, the first door 20 together with the second door 30 is rotated around the common upper rotary shaft 130 and the lower rotary shaft 134 for the first door 20, thereby opening the first storage chamber 12. In this implementation, the second connection chamber 120 is rotated such that the first and the second doors 20 and 30 can rotate together.

Next, with reference to FIGS. 5 and 6, a refrigerator will be described.

The refrigerator of this implementation is similar to the former implementation for example the second door 30 is a portion of the first door 30, but, some structures to selectively open and close the first door 20 and the second door 30 are modified For example, a mounting part 21*a* of a first door 20 is modified. That is, in the former implementation, the upper end of the mounting part 21 (with reference to FIG. 3) of the first door 20 is exposed, and thus the upper surface of the first door 20 and the upper surface of the second door 30 are on the same level. However, in this implementation, a protrusion part 39 is provided on the upper end of a first door 20, and the upper surface of a second door 30 is rotatably connected to the lower surface of the protrusion part 39. Therefore, the upper surface of the second door 20 is located at a height lower than the protrusion part 29 of the first door 20.

In this implementation, a pair of rotary shafts 139 for the first door 20 is provided on the first door 20, and a pair of rotary shafts 138 for the second door 30 is provided on the second door 30. Of course, in the same manner as the former implementation, the rotary shaft 139 for the first door 20 and the rotary shaft 138 for the second door 30 may be located coaxially, and further, the same rotary shaft may be used as an upper rotary shaft of the rotary shafts 139 for the first door 20 and an upper rotary shaft of the rotary shafts 138 for the second door 30.

In the structure of the mounting part 21*a* in this implementation, instead of the rotary shafts 138 for the second door 30, a hinge structure installed on the inner surface of the first door 20 and/or the inner surface of the second door 30 may be used.

Figure 5:
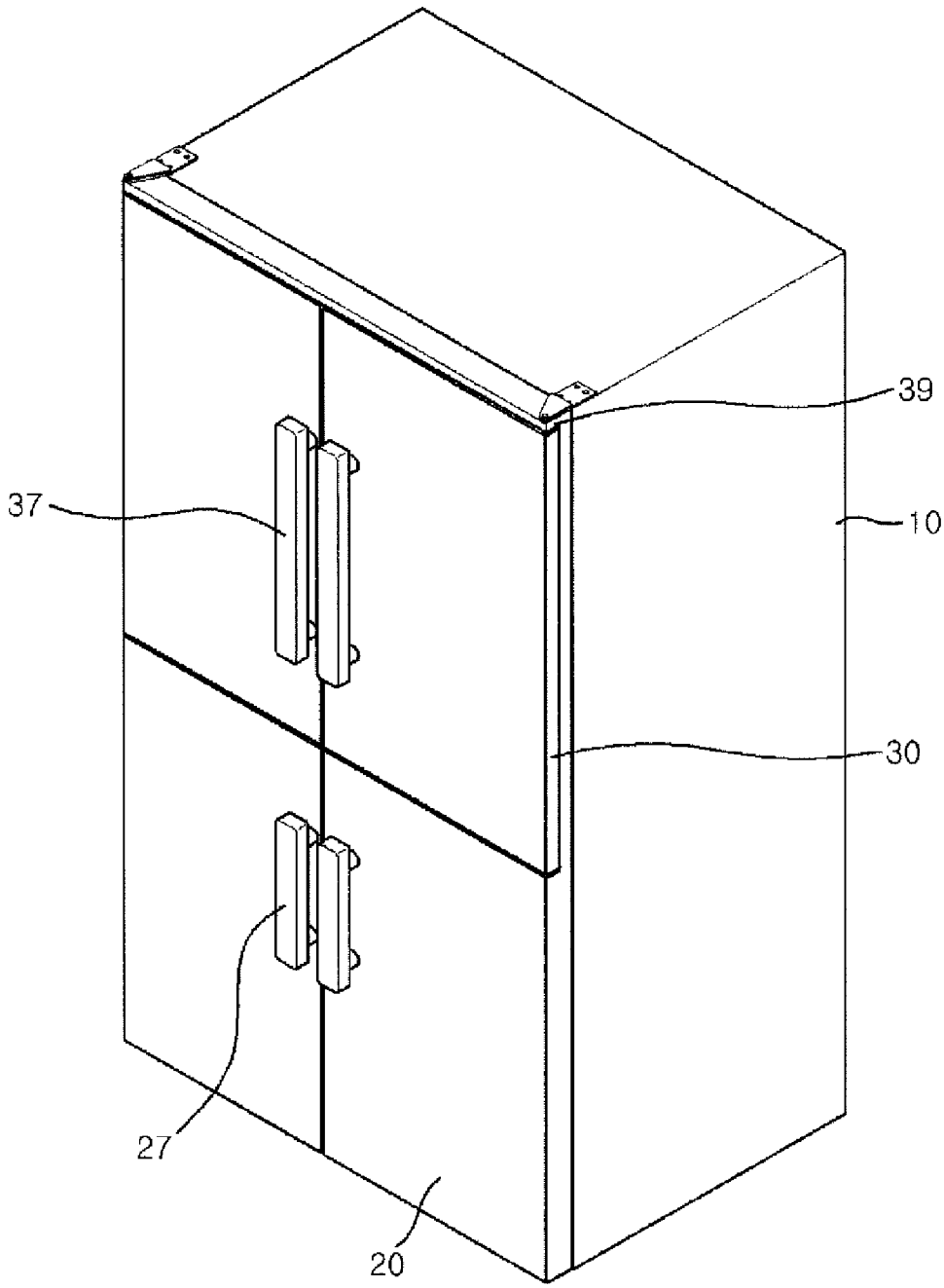
FIG. 5 is a view of a refrigerator.
Figure 6:
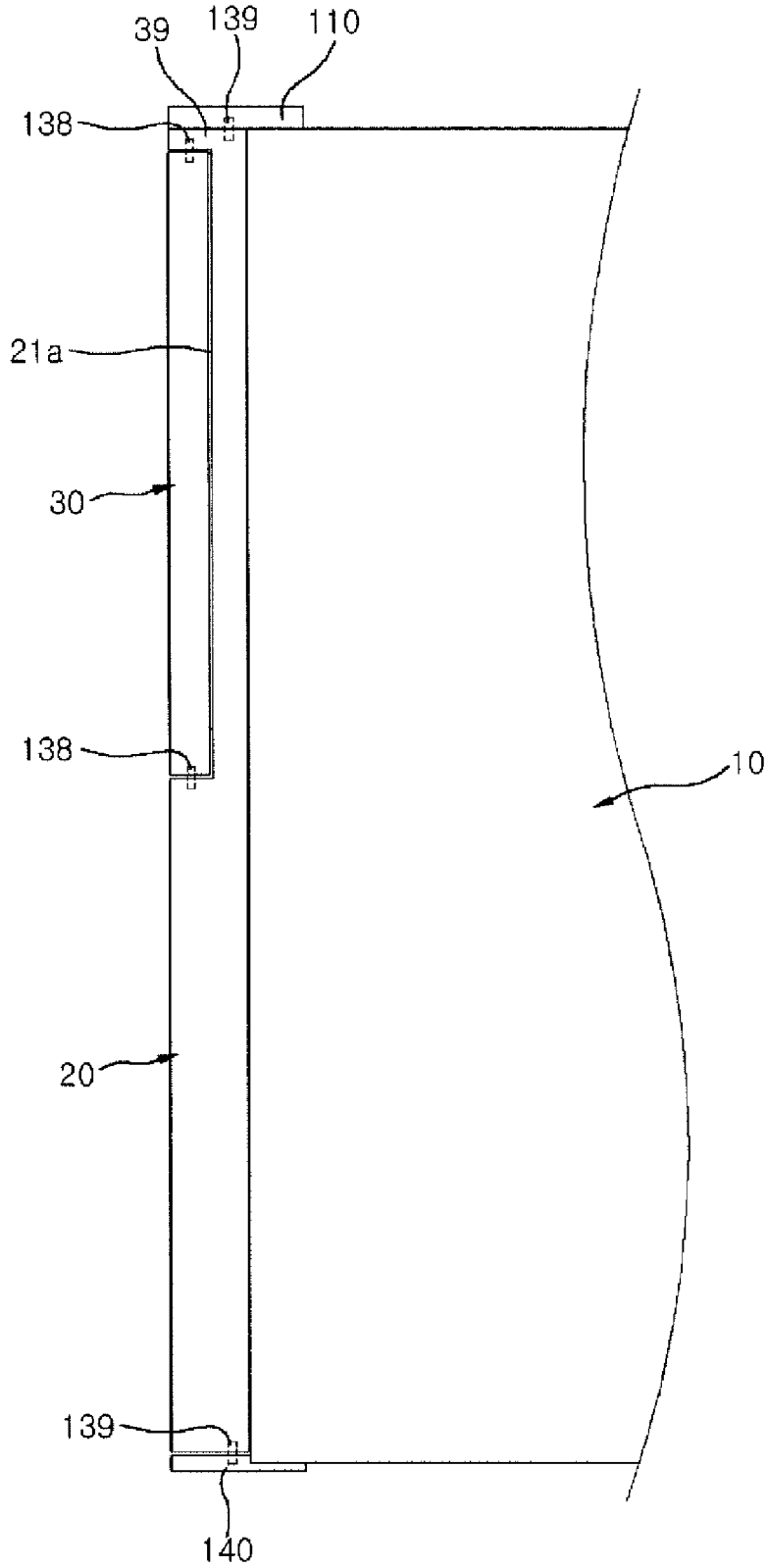
FIG. 6 is a longitudinal-sectional view of FIG. 5.

Also, FIGS. 5 and 6 illustrate that handles 27 for the first doors 20 and handles 37 for the second doors 30 are respectively provided on the outer surfaces of the first doors 20 and the second doors 30. The structure of the handles is not limited thereto, that is, as described in the former implementation, concave parts serving as handles may be provided on the first doors 20 and the second doors 30, respectively.

Although this implementation illustrates the side by side type refrigerator, the present technology is not limited thereto. In some examples, it may be applied to a top freezer type refrigerator in which a freezing chamber is located at the upper portion of a main body, or a bottom freezer type refrigerator in which a freezing chamber is located at the lower portion of a main body. Further, the present technology may be applied to a refrigerator in which a refrigerating chamber is located at the upper portion of a main body and a freezing chamber is located at the lower portion of the main body, the freezing chamber is opened and closed by a drawer type door 90 and the refrigerating chamber is opened and closed by a pair of doors rotated around a pair of vertical shafts, as shown in FIG. 7.

Figure 7:
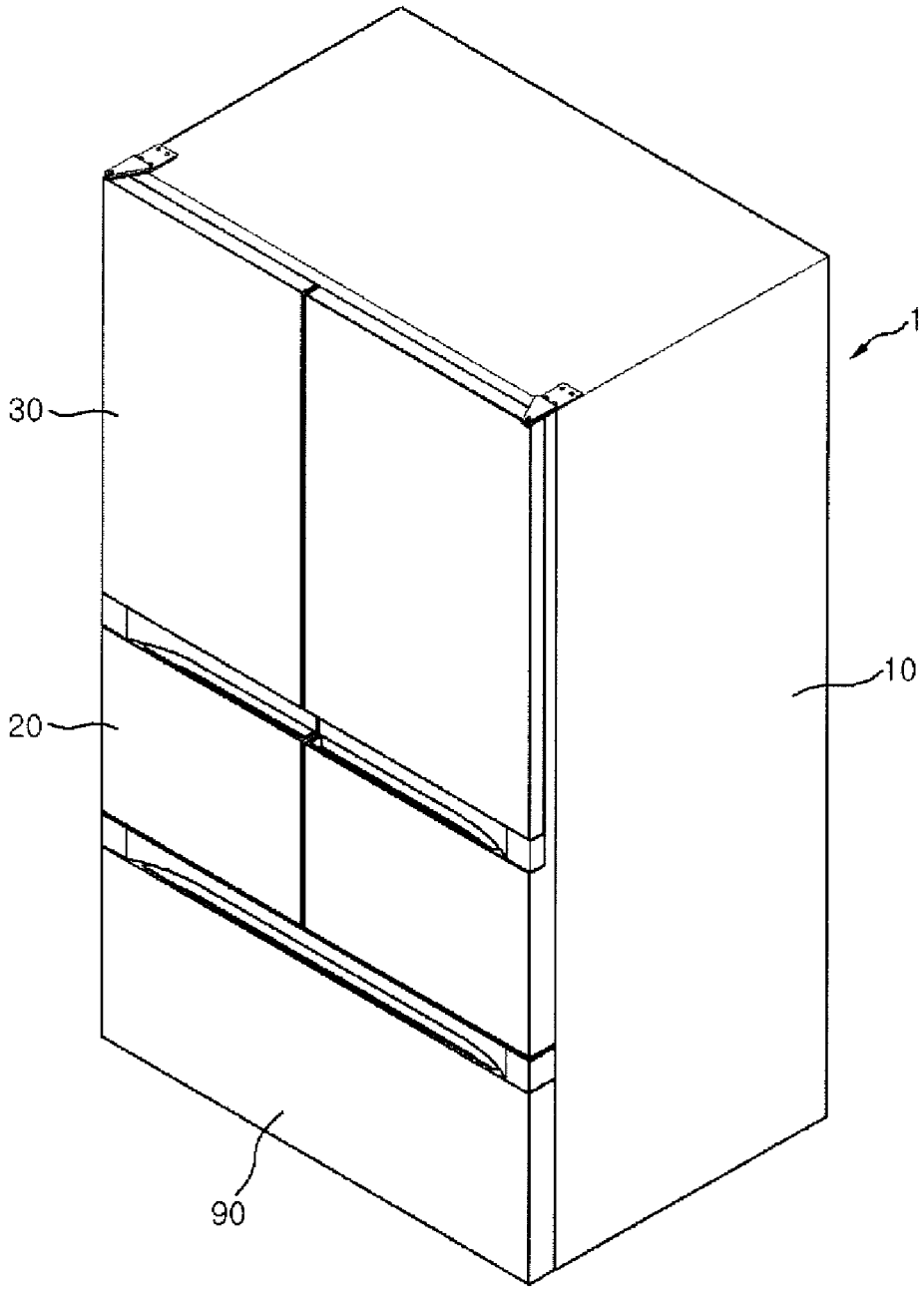
FIG. 7 is a view of a refrigerator.

As shown in FIG. 7, this embodiment illustrates that a shape of the first door corresponds to a shape of the second door, for example, a width of the first door and a width of the second door are equal and a length of the second door is shorter than a length of the first door. The present technology is not limited thereto. For example, the present technology may be applied to a refrigerator in which width and height of a second door are less than those of a first door.

Further, a different type of a second door, which are, for example, rotated in a direction differing from a rotating direction of the first doors, may be provided.

Figure 8:
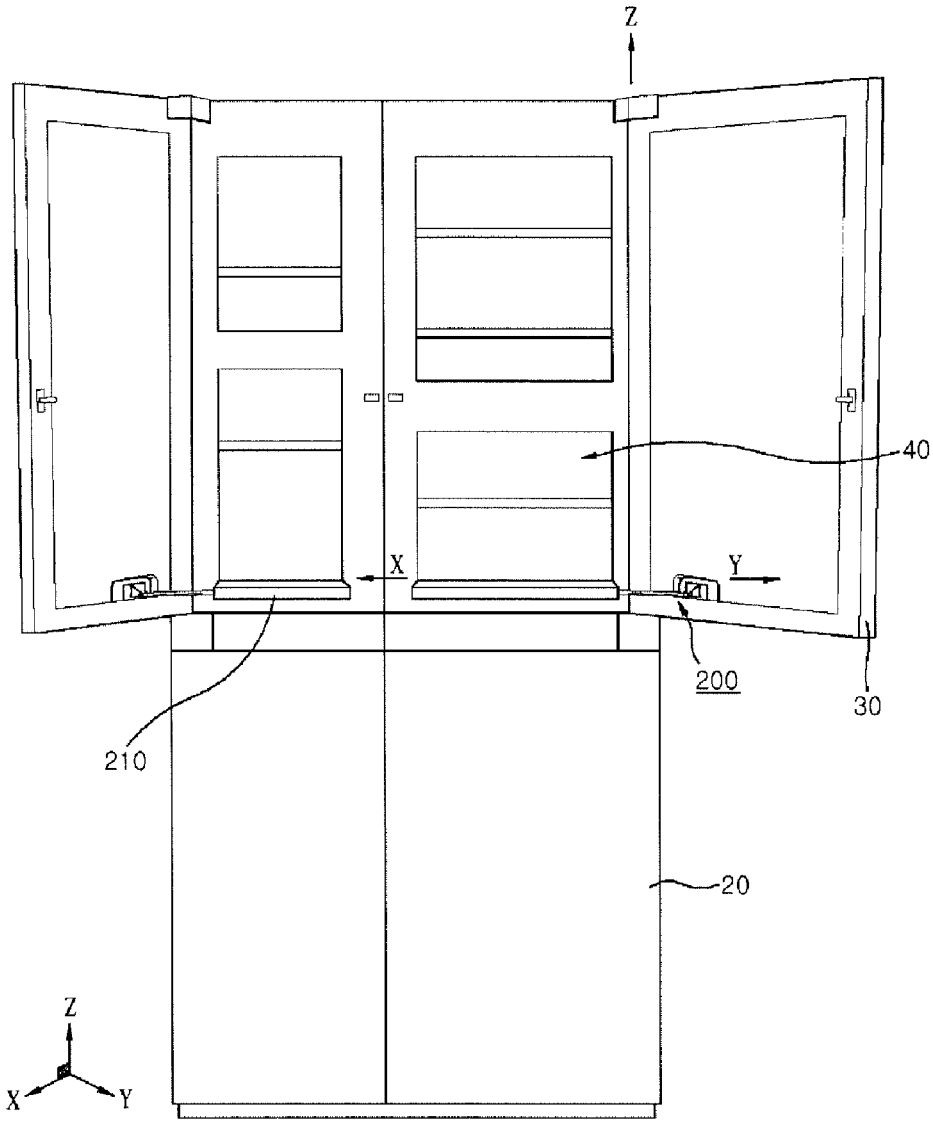
FIG. 8 is a view of a refrigerator.

Next, with reference to FIG. 8, a refrigerator will be described as follows.

In this implementation, a supporting member 210 is provided between a second storage chamber 40 and a second door 30, and the supporting member 210 is operated in connection with opening and closing of the second door 30. For example, when the second door 30 is opened, the supporting member 210 is opened in connection with the opening of the second door 30, and when the second door 30 is closed, the support 210 is closed in connection with the closing of the second door 30.

The second door 30 is rotatably connected to a first door 20, and the supporting member 210 is rotatably connected to the second storage chamber 40. Further, a motion conversion unit 200 to convert rotation of the second door 30 into rotation of the supporting member 210 is provided between the second door 30 and the support 210, and thus converts a motion of the second door 30 into a motion of the supporting member 210.

Now, rotating directions of the second door 30 and the supporting member 210 will be described. As an example, the second door 30 is rotated around a vertical axis (hereinafter, referred to as "a first axis (a door rotary axis)") Z, and the supporting member 210 is rotated around an axis (hereinafter, referred to as "a second axis (a support rotary axis)") X being perpendicular to the first axis Z and being parallel with the ground. The motion conversion unit 200 serves to convert rotation of the second door 30 around the first axis Z into rotation of the supporting member 210 around the second axis X. Here, one end (a portion connected to the second door 30) of the motion conversion unit 200 is rotated around an axis (hereinafter, referred to as "a third axis (a conversion rotary axis)") Y being perpendicular to the first axis Z and the second axis X, i.e., being parallel with the ground but perpendicular to the second axis X.

Further, any other movements of the supporting member 210 is within the scope of this disclosure. For example, the supporting member can move a forward or backward direction like movement of a tray in response to movement of the second door 30. That is, when the second door 30 is opened, the supporting member 210 moves a forward direction to open and when the second door 30 is closed, the supporting member 210 moves a backward direction to close.

Figure 9:
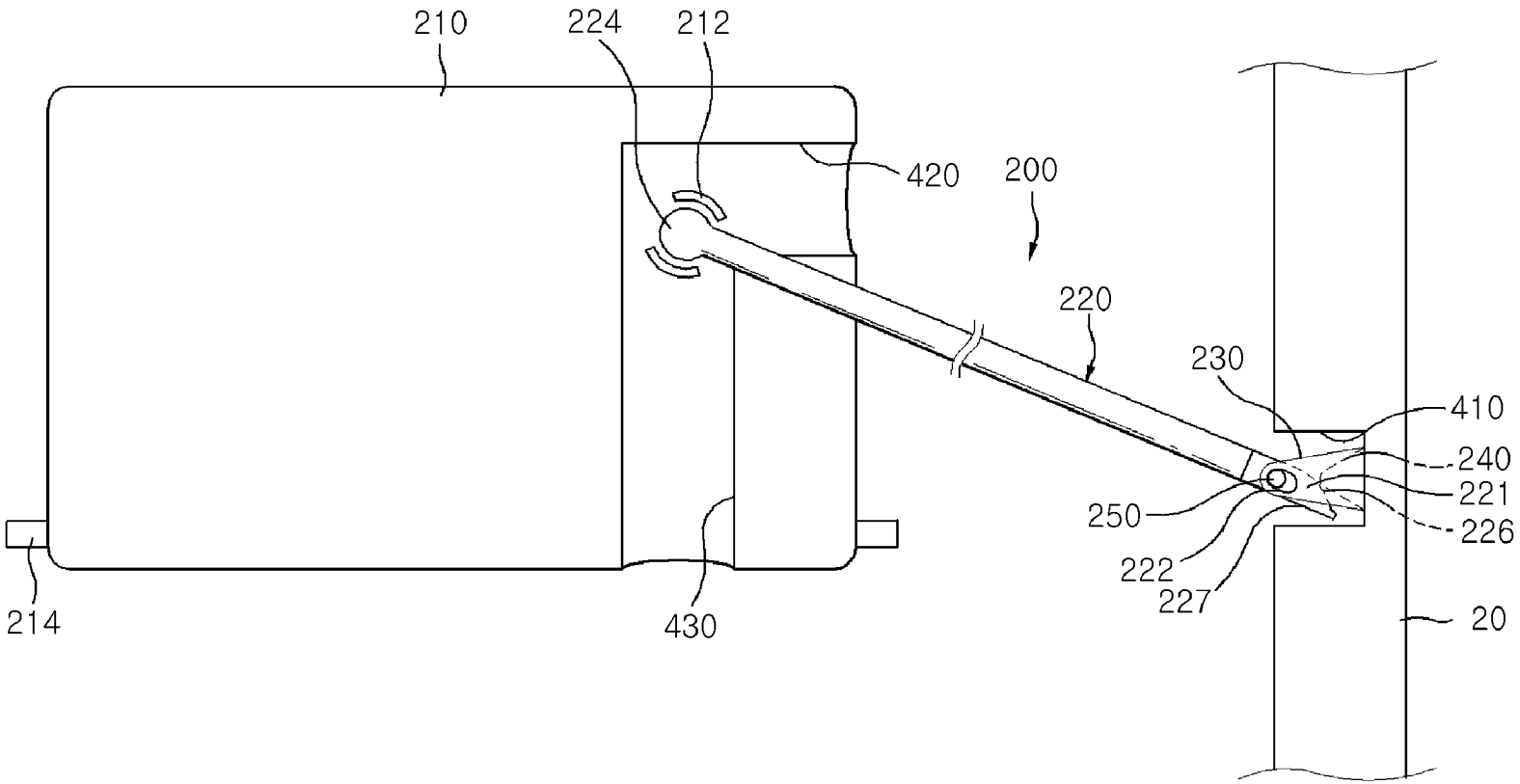
FIG. 9 is a side view schematically illustrating a connection part between a door and a support in FIG. 8.
Figure 10:
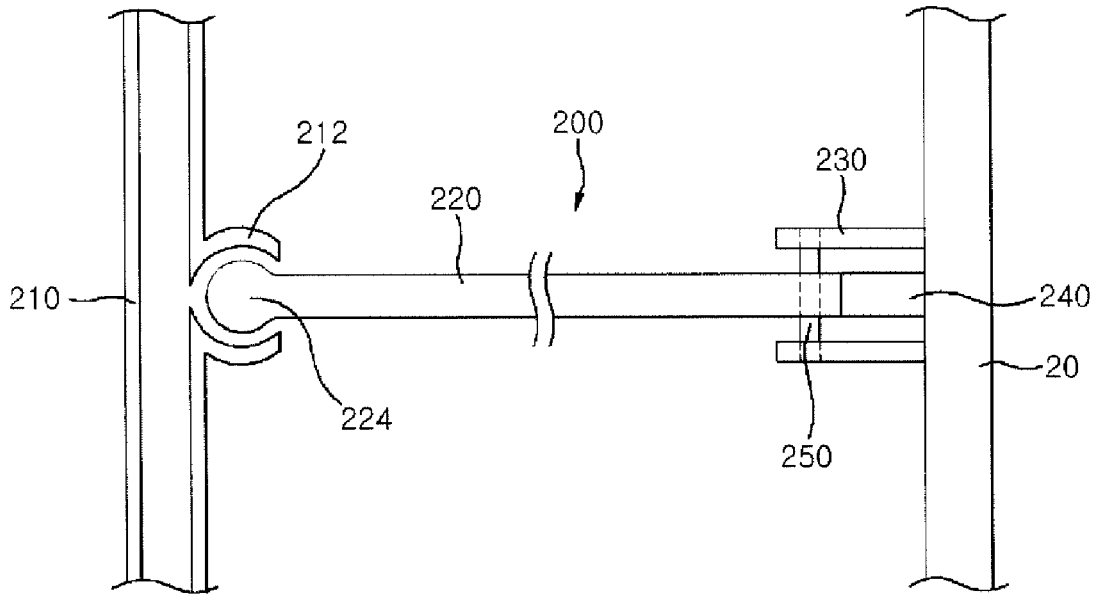
FIG. 10 is a plan view of FIG. 9.

Now, with reference to FIGS. 9 and 10, the motion conversion unit will be described in detail.

In the motion conversion unit 200, one end of a link member 220 is connected to the second door 30 and the other end of the link member is connected to the supporting member 210. For example, a door connection part 221 is rotatably connected to the second door 30, and a support connection part 224 is universally supported by the support 210.

In more detail, one end of the connection member 230 is connected to the inner surface of the second door 30, and the other end of the connection member 230 is connected to the door connection part 221 by means of a rotary shaft 250. Therefore, when the second door 30 is rotated around the door rotary axis Z (in FIG. 8), the door connection part 221 of the link member 220 is rotated around the conversion rotary shaft 250. When the door connection part 221 of the link member 220 is rotated, the support connection part 224 of the link member 220 moves up and down. Therefore, the supporting member 210 connected to the support connection part 224 is rotated around a support rotation shaft 214. A length of the link member 220 may be properly determined in consideration of installed positions and radiuses of rotation of the supporting member 210 and the second door 30.

Hereinafter, the door connection part 221 will be described in detail.

For example, a curved part 226 having a designated curvature is provided on one end of the link member 220, and a cam part 240 corresponding to the curved part 226 is provided on the second door 30. Through this configuration, when the second door 30 is rotated, the cam part 240 moves down along the curved part 226 of the door connection part 221 and then presses down the link member 220, thereby allowing the link member 220 to be more smoothly rotated.

Further, a stopper 227 extended outward is provided at the tip of the door connection part 221. When the supporting member 210 becomes level, the stopper 227 is caught by the cam part 240, and thus serves to easily support the leveled the supporting member 210.

In some examples, a concave part 410 is provided on the inner surface of the second door 30, and the connection member 230 and the cam part 240 may be located in the concave part 410 when the second door 30 is closed.

Further, the door connection part 221 is connected to the rotary shaft 250 of the link member 220 at a designated clearance. In this implementation, a connection hole 222, to which the rotary shaft 250 is rotatably connected, has a greater inner diameter than an outer diameter of the rotary shaft 250 and is defined as an oval shape extended in the lengthwise direction of the link member 220. Through this configuration, when the second door 30 is closed, damage to the motion conversion unit 200 is prevented, and motion conversion by the motion conversion unit 200 is reasonably achieved.

Hereinafter, the support connection part 224 will be described in detail.

The support connection part 224 is supported by the bottom surface of the support 210. For example, the support connection part 224 and the supporting member 210 are connected by a ball joint. For this purpose, a support holding part 212 is provided on the bottom surface of the supporting member 210, and the support connection part 224 is connected to the support holding part 212.

In this implementation, concave parts 420 and 430 are provided on the bottom surface of the support 210. The concave parts 420 and 430 include a first concave part 430 being parallel with the door rotary shaft under the condition that the support 210 is closed, and a second concave part 420 being parallel with the support rotary shaft 214. The first concave part 430 serves to support the motion conversion unit 200, particularly the link member 220, when the second door 30 is closed, and the second concave part 420 serves to support the link member 220 from below, when the second door 30 is opened.

Hereinafter, with reference to FIGS. 11(*a*), 11(*b*), and 11(*c*), an operation of the second door in accordance with this implementation will be described.

Figure 11:
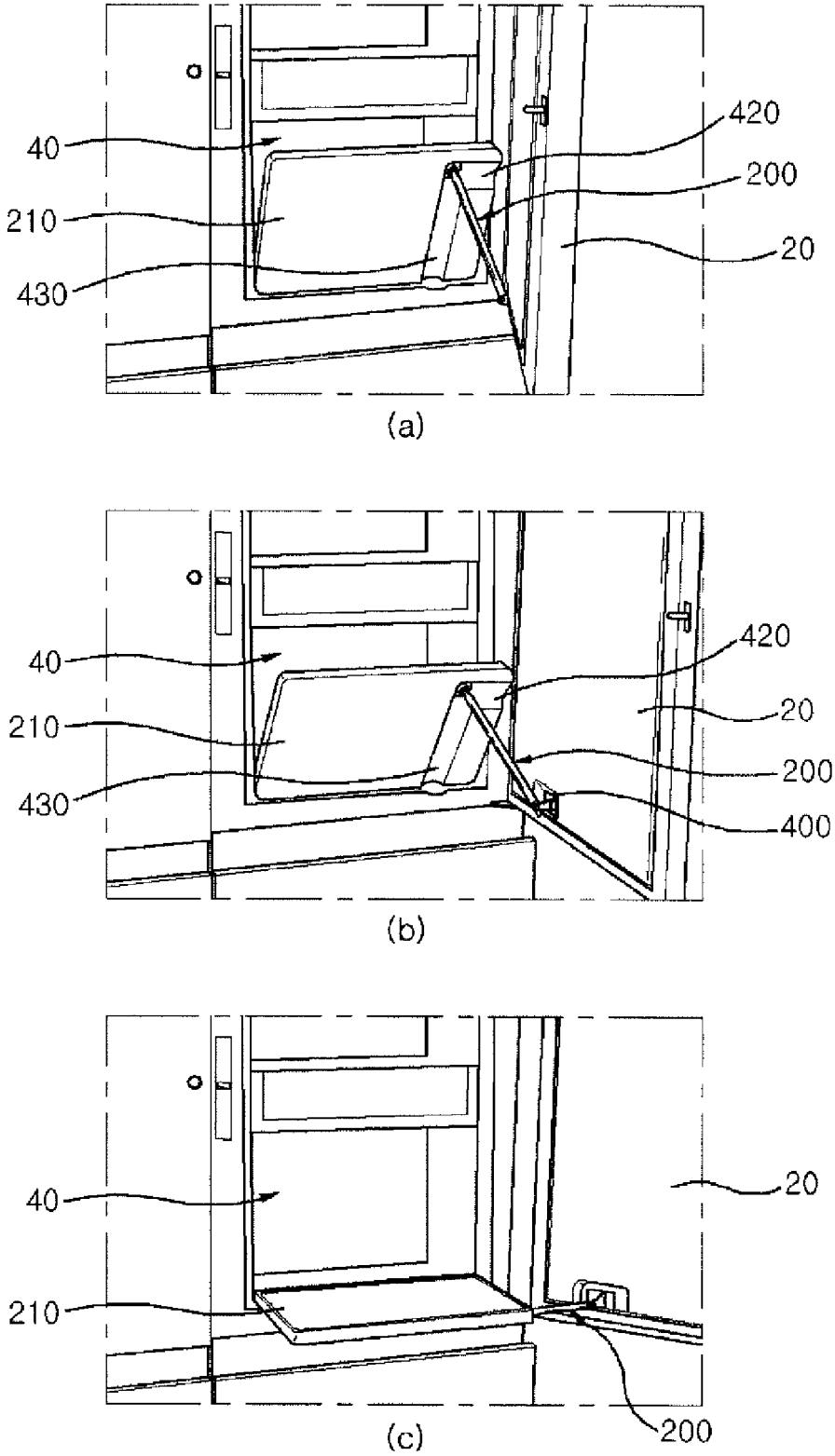
FIGS. 11(*a*), 11(*b*), and 11(*c*) are views illustrating an operation of the door of the refrigerator of FIG. 8.

As shown in FIGS. 11(*a*) and 11(*b*), when the second door 30 is opened, the supporting member 210 is also opened by the motion conversion unit 200 connected to the second door 30. Here, since one end of the link member 220 of the motion conversion unit 200, i.e., the door connection part 221 is rotated downward, and the other end of the link member 220, i.e., the support connection part 224 pulls the front end of the support 210 downward, the supporting member 210 is rotated around the support rotary shaft 214 and thus is opened. As shown in FIG. 11(*c*), when the support 210 is completely opened, the link member 220 contacts the second concave part 420 on the bottom surface of the supporting member 210, and thus supports the supporting member 210. When the second door 30 is closed, the above operation is carried out in reverse order, and a detailed description thereof will be omitted.

In this implementation, the supporting member 210 may have a tray to extend an supporting area. When the second door 30 is opened and the supporting member 210 is also opened. A user then pulls out foods from the second storage chamber 40 and puts the foods on the supporting member 210. In that case, a space of the supporting member 210 may be enough to put a lot of foods on the supporting member 210. Meanwhile, the user sometimes put a few foods on the supporting member 210 and sometimes put a lot of foods on the supporting member 210. If the supporting member has a tray, the user can adjust the space of the supporting member 210. For example, if the user wants to put a lot of food on the supporting member 210 at once, the user use the tray so that the supporting area or space can enlarge enough to put the foods on there.

Although this implementation illustrates that the supporting member 210 is provided between the second storage chamber 40 and the second door 30, the present disclosure is not limited thereto. For example, the principle of the present invention may be applied to a case in which a supporting member is provided between a first storage chamber and a first door. Further, the principle of the present invention may be applied to a conventional refrigerator, i.e., a refrigerator provided with storage chambers and doors to open and close the storage chambers, as long as supports and motion conversion units are provided between the storage chambers and the doors.

As is apparent from the above description, when a door is opened and closed, a supporting member is automatically opened and closed in connection with the opening and closing of the door, thereby increasing convenience in use of the refrigerator.

Also, the supporting member opened and closed in connection with the opening and closing of the door may be used as a kind of subsidiary door, thereby increasing convenience in use of the refrigerator.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a cabinet;

a first storage chamber defined within the cabinet;

a first door configured to open and close at least a portion of the first storage chamber, the first door having a first rotational shaft that enables rotation of the first door;

a second storage chamber that is smaller than the first storage chamber, that is defined at a side of the first door, and that is configured to move with the first door;

a second door that is configured to open and close the second storage chamber by rotating in a same direction as the first door and that enables access to the second storage chamber when the first door is oriented in a closed position, wherein:

the second door has a second rotational shaft that enables rotation of the second door and that is parallel to the first rotational shaft, and a shape of the second door corresponds to a shape of the first door such that a width of the second door is substantially equal to a width of the first door and a thickness of the second door is substantially equal to a thickness of a mounting part of the first door on which the second door is positioned; and a supporting member positioned at the second storage chamber and configured to move between a supporting position and a stored position in connection with opening and closing of the second door, wherein:

the supporting member extends out of the second storage chamber in the supporting position and the supporting member is located within the second storage chamber in the stored position, and the supporting member rotates in a different direction than the first door and the second door and has a third rotational shaft that enables rotation of the supporting member and that is perpendicular to the first rotational shaft and the second rotational shaft.

2. The refrigerator of claim 1, wherein the supporting member is configured to rotate about a rotational axis in response to opening and closing of the second door.

3. The refrigerator of claim 1, wherein the supporting member is configured to rotate from the stored position to the supporting position in response to opening of the second door and rotate from the supporting position to the stored position in response to closing of the second door.

4. The refrigerator of claim 1, further comprising:

a motion conversion unit coupled to the second door and the supporting member, respectively, and configured to convert rotation of the second door into movement of the supporting member.

5. The refrigerator according to claim 4, wherein the motion conversion unit comprises a link member and a door connection part.

6. The refrigerator of claim 5, further comprising:

a connection hole configured to connect the second door and the motion conversion unit, wherein the connection hole extends in a lengthwise direction of the link member.

7. The refrigerator of claim 1, wherein when the second door is opened, the supporting member is opened in connection with the opening of the second door, and when the second door is closed, the supporting member is closed in connection with the closing of the second door.

8. The refrigerator of claim 1, wherein the supporting member is positioned at a lowermost surface of the second storage chamber such that, in the supporting position, the supporting member is adjacent to the lowermost surface of the second storage chamber.

9. The refrigerator of claim 1, wherein the second door aligns with an uppermost edge of the first door when the second door is oriented in a closed position.

10. The refrigerator of claim 1, wherein the second door aligns with three edges of the first door when the second door is oriented in a closed position.

11. The refrigerator of claim 1:

wherein a first depth of a first part of the first door is narrower than a second depth of a second part of the first door and a stepped portion of the first door is located where the first door changes from the first depth to the second depth; and wherein the second door is located at the first part of the first door that has the first depth.

12. The refrigerator of claim 11, further comprising a handle provided at the stepped portion of the first door that enables a user to open and close the first door, wherein the second door is spaced apart from the stepped portion of the first door to enable a user to access the handle provided at the stepped portion of the first door.

13. The refrigerator of claim 12, wherein the handle comprises a horizontal recess positioned at the stepped portion of the first door.

14. The refrigerator of claim 13, wherein the handle is positioned at about a center of the first door and the second door is positioned above the handle.

15. The refrigerator of claim 12, wherein, when the second door is oriented in a closed position, a front surface of the second door aligns with a front surface of the first door at the second part of the first door that has the second depth.

16. The refrigerator of claim 1, further comprising:

a hinge assembly that is coupled to the first door and the second door and that establishes a rotational axis for the first door and the second door.

17. The refrigerator of claim 16, further comprising:

a first connection member configured to connect the hinge assembly to the cabinet.

18. The refrigerator of claim 17, further comprising:

a second connection member configured to connect the second door to the first door.

19. The refrigerator of claim 1, wherein a rotational axis of the first door is located at a same position as a rotational axis of the second door.

20. The refrigerator of claim 1, wherein the height of the second door is about half of the height of the first door.

21. The refrigerator of claim 1, further comprising:

a first hinge that attaches an upper portion of the first door;

a second hinge that attaches a lower portion of the first door to a lower portion of the cabinet;

a third hinge that attaches an upper portion of the second door; and a fourth hinge that attaches a lower portion of the second door to the first door at a location of the first door that is between the first and second hinges.

22. The refrigerator of claim 21, wherein the first hinge and the third hinge are part of a single hinge assembly.

* * * * *